United States Patent [19]

Costigan

[11] 4,355,794

[45] Oct. 26, 1982

[54] SPREADING MACHINE CUTTER BOX ASSEMBLY

[75] Inventor: Conrad A. Costigan, Richmond Hill, N.Y.

[73] Assignee: Spreading Machine Exchange, Inc., New York, N.Y.

[21] Appl. No.: 175,254

[22] Filed: Aug. 4, 1980

[51] Int. Cl.[3] ..... B65H 29/46

[52] U.S. Cl. ..... 270/31; 83/87; 83/485; 83/487; 83/508; 83/568; 83/583; 83/614; 83/658

[58] Field of Search ..... 270/30, 31; 83/347, 83/348, 507, 508.2, 566, 568, 570, 582, 583, 614, 623, 658, 87, 485, 487, 508

[56] References Cited

U.S. PATENT DOCUMENTS

| | | | |
|---|---|---|---|
| 2,281,877 | 5/1942 | Green | 83/658 |
| 3,024,688 | 3/1962 | Romm | 83/566 |
| 3,447,409 | 6/1969 | Lewis | 83/583 |
| 3,496,817 | 2/1970 | Staats et al. | 83/614 |
| 3,540,337 | 11/1970 | Gardner | 83/614 |
| 3,561,312 | 2/1971 | Jones | 83/614 |
| 3,858,475 | 1/1975 | Thater | 83/583 |
| 4,156,378 | 5/1979 | Felten | 83/582 |

FOREIGN PATENT DOCUMENTS

| | | | |
|---|---|---|---|
| 1410064 | 7/1965 | France | 83/566 |
| 233149 | 10/1944 | Switzerland | 83/348 |

*Primary Examiner*—Robert C. Watson
*Assistant Examiner*—K. Bradford Adolphson
*Attorney, Agent, or Firm*—Edward F. Levy

[57] ABSTRACT

In a spreading machine for laying fabric or other sheet material on a cutting table, a cutter box assembly is provided for cutting off the sheet material at the end of each layer spread. The cutter box assembly includes a housing mounted on the spreading machine carriage, a cutter frame movably mounted in the housing, a cutter disk rotatably mounted on said cutter frame, and drive apparatus for moving the cutter frame, and the cutter disk carried thereby, from one end of the housing to the other, when the machine carriage reaches the limit of its travel along the table. A spring-mounted pressure bar bears against the edge of the cutter disk, and the sheet material is fed between the cutter disk and the pressure bar. When the cutter frame is driven in a cutting stroke, the cutter disk rolls along said pressure bar and traverses the sheet material forcing its way through the material to perform a scoring cut and causing the material to part. An extension arm on the cutter frame supports a cam-mounted roller which bears against the rear of the pressure bar, holding the pressure bar against the cutter disk and preventing bunching of the sheet material and interruptions of the cut.

13 Claims, 8 Drawing Figures

FIG. 3
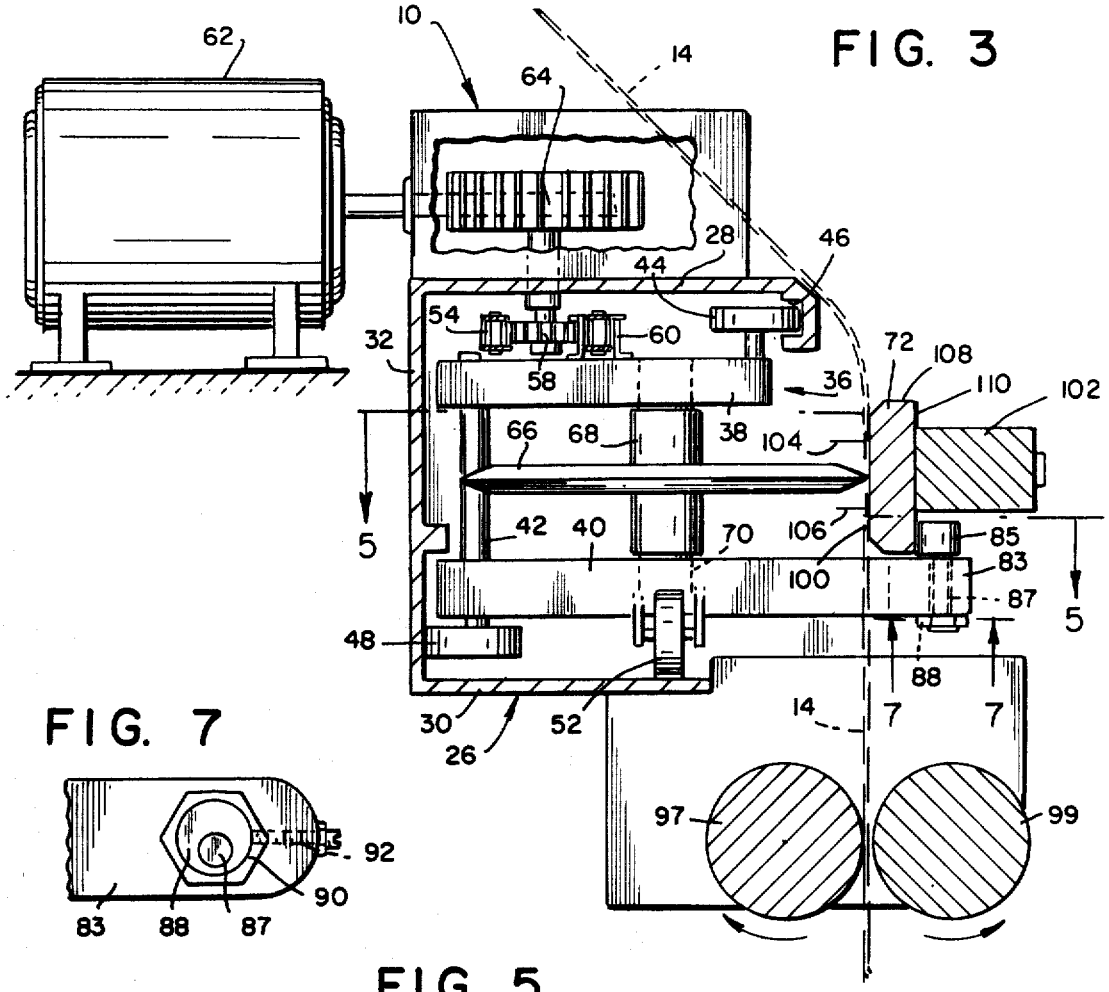
FIG. 7
FIG. 5
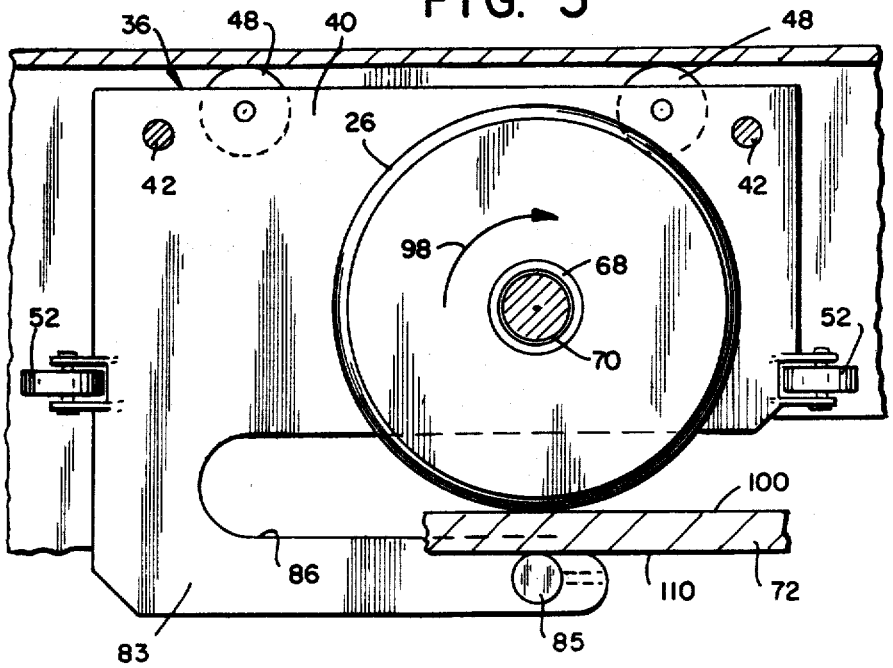
FIG. 8
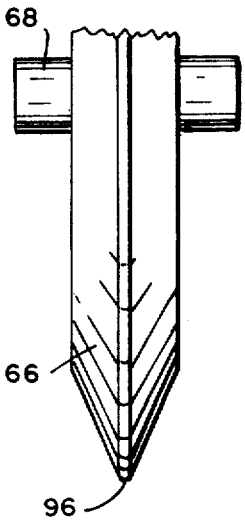

SPREADING MACHINE CUTTER BOX ASSEMBLY

BACKGROUND OF THE INVENTION

The present invention relates to fabric spreading machines, and in particular to a novel and improved fabric cutting assembly for such machines.

The prior art related to the manufacture of clothing or other articles of fabric or film materials includes numerous examples of equipment which functions to spread and cut layers of sheet material, on a cutting table. Typical of such equipment are fabric spreading machines which carry a supply of fabric, usually in roll form, and which operate to lay down on a table surface superimposed layers or sheets of the fabric as the machine carriage is moved back and forth over the table surface. At the end of each run of the machine carriage, the fabric material deposited must be cut to separate the laid-down sheet, and a motor-driven cutting assembly is often provided for this purpose.

Conventional cutting assemblies consist of an enclosed cutter box which extends transversely across the width of the spreading machine carriage and through which the fabric material is fed as it is laid down on the table. A circular knife blade is rotatably mounted in the cutter box in combination with motorized drive elements which move the knife blade in a cutting stroke across the length of the cutter box and at the same time rapidly rotates the circular knife blades. Thus, as the knife blade is drawn along the width of the fabric fed through the cutter box, the rotating knife blade slits through the fabric to complete the cut and allow the severed sheet of fabric to drop to the table surface.

Conventional cutting assemblies of this type are subject to numerous deficiencies, among which is the tendency of the rotating knife blade to become dull frequently during its slitting operation and, therefore, requiring the spreading machine to be shut down periodically in order to sharpen the knife blade. This requirement results in a loss of productive time and continuing operating costs for resharpening the knife blades and replacement of the knife blades after they can no longer be resharpened.

Another disadvantage of such conventional cutting assemblies results from the nature of the cutting action performed by conventional rotating circular knife blades which depend on the sharpness of their cutting edge to pierce or slit through the material being cut. This piercing action of the cutting edge makes it difficult to impossible to cut certain materials, for example, extremely thin fabrics such as tricot, and extremely thin plastic films such as cellophane. These materials tend to bunch up rather than permit the blade to pierce through them, thereby resulting in uneven cuts or in interrupted or incomplete cuts. When a cut is incomplete, production must be halted while the cut is completed by hand.

Another disadvantage of conventional cutting equipment is related to the cutting of coated fabrics. The coating on such fabrics tends to build up on the knife edge quickly, causing the blade to become dull, and forcing an interruption in production. The coating also makes it difficult to sharpen the knife blades.

It is, thus, evident that certain sheet materials are not suitable for use with spreading machines having cutting assemblies of the conventional type described above.

It is a principal object of the present invention to overcome the disadvantage of the prior art by providing a cutter box assembly for cutting sheet materials which is capable of sustained operation while cutting a wide variety of coated and uncoated materials without excessive down-time.

Another object of the present invention is to provide a cutter box assembly which is capable of efficiently cutting relatively thick sheet materials as well as thin and even sheer sheet materials.

Another object of the invention is to provide a cutter box assembly which does not rely on a sharp-edged knife blade for operation, and thus eliminates the need for periodically resharpening the blade.

Another object of the invention is the provision of a cutter box assembly in which the contained circular knife is not driven for rotation, but rather rolls along a pressure bar as it is moved from one end of the cutter box to the other, thereby cutting the fabric fed between the knife blade and the pressure bar in a scoring action rather than in a slitting action.

A further object of the invention is to provide a cutter box assembly in which the aforementioned pressure bar bears against the circular cutter knife and is mounted for self-adjustment to multiple positions within the assembly, thereby insuring an effective cut regardless of thickness irregularities in the fabric.

SUMMARY OF THE INVENTION

In accordance with the present invention, there is provided a cutter box assembly which is mounted on the carriage of a sheet material spreading machine which is adapted to travel along a cutting table spreading sheet material such as fabric or plastic film onto the surface of the cutting table in superimposed layers from a supply roll mounted on the machine carriage. A cutter frame is mounted for reciprocating sliding movement in guide ways within the cutter box and is connected to a drive chain which is disposed to drive the cutter frame transversely across the width of the cutting table. The cutter frame carries a rotatably mounted circular cutter disk which has a convexly rounded edge. A pressure bar is mounted on the machine carriage by means of helical compression springs which urge the pressure bar to bear against the rounded edge of the cutter disk. The cutter frame further includes an extension arm on which is mounted an adjustably positionable roller which is disposed behind the pressure bar, generally in line with the cutter disk, and which urges the pressure bar to bear against the cutter disk.

In use, fabric or film material from the supply roll is fed between the cutter disk and the pressure bar. Electrical limit switches control an electrical motor to operate the drive chain to drive the cutter frame across the width of the material. As the cutter frame moves, the cutter disk rolls along the pressure bar and forces its way through the material, causing the material to separate.

The pressure exerted by the revolving cutter disk is sufficient to cut a wide variety of materials including fabrics, plastic films and even light metals and wire.

Additional objects and advantages of the invention will become apparent during the course of the following specification, when taken in connection with the accompanying drawings, in which:

BRIEF DESCRIPTION OF THE DRAWING

FIG. 3 is an enlarged cross-sectional view of the cutter box assembly, as taken along line 3—3 of FIG. 1, with the material being processed shown in broken lines;

FIG. 5 is a fragmentary cross-sectional view taken along the line 5—5 of FIG. 3;

FIG. 7 is an enlarged fragmentary cross-sectional view taken along the line 7—7 of FIG. 3; and FIG. 8 is a fragmentary side elevational view of the cutter disk, drawn to an enlarged scale.

DESCRIPTION OF THE PREPARED EMBODIMENTS

Figure 1:
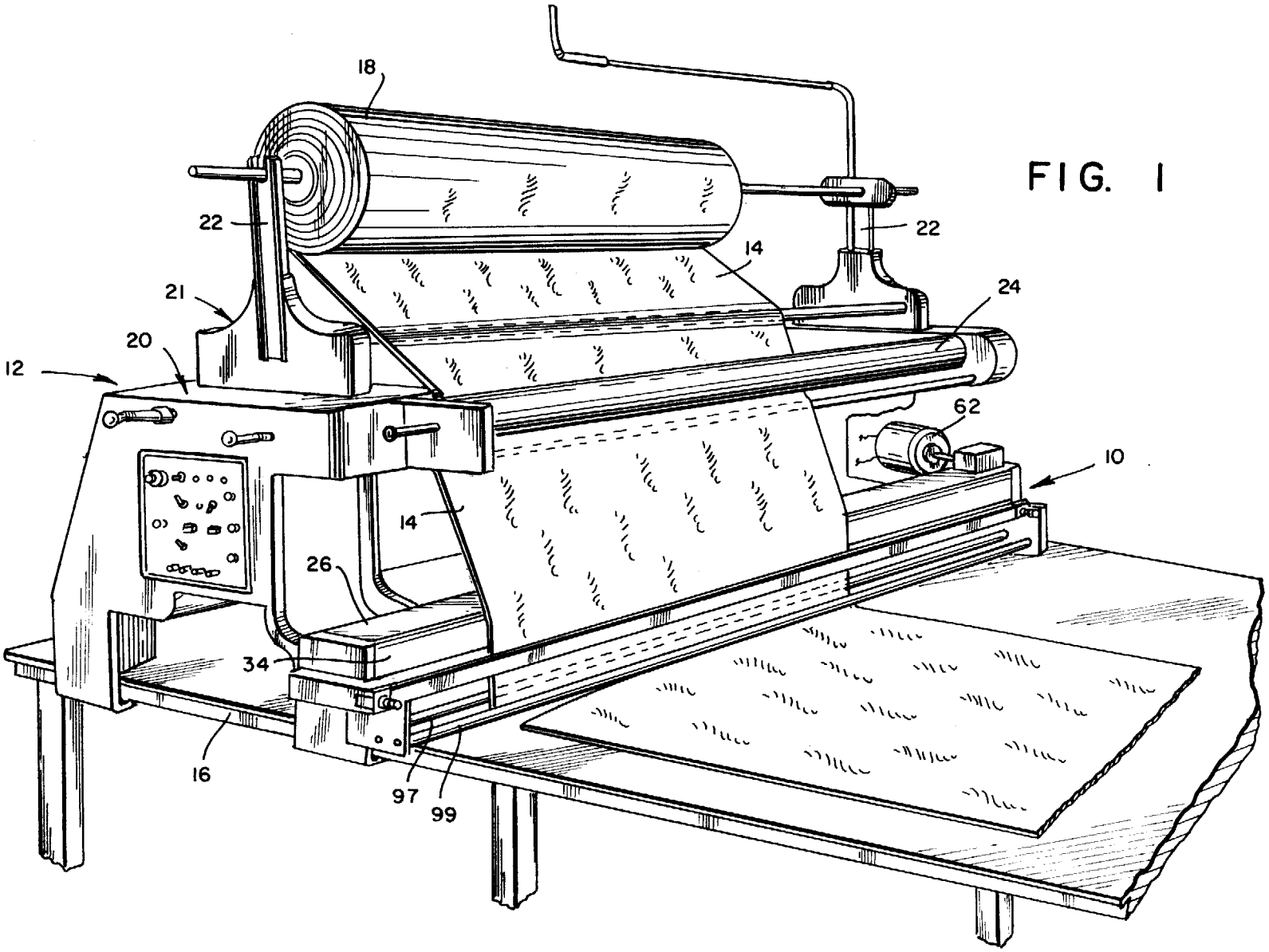
FIG. 1 is an overall perspective view of a cutter box assembly made in accordance with the present invention, and shown installed on a conventional spreading machine for depositing layers of fabric or other sheet material on a cutting table.

Referring in detail to the drawings, there is shown in FIG. 1 a cutter box assembly 10 made in accordance with the present invention and shown mounted on a spreading machine 12 adapted to deposit layers of fabric 14 or other sheet material onto a cutting table 16.

The cutter box assembly 10 may be used in conjunction with any suitable type of sheet material spreading apparatus. The spreading machine 12 is illustrated by way of example of such apparatus, and consitutes a conventional fabric spreading machine which is motor driven to travel back and forth over the table surface, and which is of the turntable type. Since the machine 12 in itself forms no part of the present invention, its structure will not be described in detail, other than to indicate the major components which feed the fabric through the cutter box assembly 10 to the table surface. The spreading machine 12 generally comprises a base frame or carriage 20 mounted on wheels (not shown), and guided for movement lengthwise of the cutting table. Mounted on the carriage 20 is a turntable frame 21 including a pair of spaced uprights 22 between which a supply roll 18 of the fabric 14 may be rotatably mounted. The machine also includes a positive feed roller 24 which is rotatably driven in synchronization with the movement of the machine carriage along the table, and which serves to draw fabric from the supply roll 18 and feed the fabric 14 through the cutter box assembly 10 to the table surface.

As is shown in FIG. 1, the cutter box assembly 10 operates to cut the fabric or other sheet material 14 when the machine carriage 20 comes to a halt at the end of its run in spreading a layer of fabric on the table 16. The cutter box assembly 10 includes an elongated box-like support frame or housing 26 which is secured to the front end of the machine carriage 20 and extends across the width thereof. The housing 26 has a top wall 28, bottom wall 30, rear wall 32 and an open front which is normally covered by a removable cover plate 34, (FIG. 1).

Movably mounted within the housing 26 is a cutter frame 36 comprising a pair of plates 38 and 40 interconnected in spaced-apart relationship by posts 42. As best seen in FIG. 3, a guide roller 44 is rotatably mounted on the upper plate 38, with its axis of rotation generally perpendicular to the plane of the upper plate 38. The guide roller extends into a guideway in the nature of an elongated slot 46 formed in the housing 26 and extending the length thereof. The lower plate 40 similarly mounts a pair of spaced guide rollers 48 which rest against and roll upon the inner surface of housing rear wall 32. The axes of these guide rollers 48 are generally perpendicular to the plane of the lower plate 40. In addition, a pair of vertically-disposed guide rollers 52 are rotatably mounted at opposite ends of the lower plate 40, as shown in FIGS. 3 and 5, these rollers 52 resting upon the inner surface of the housing bottom wall 30. The axes of rotation of the rollers 52 are each generally parallel to the plane of bottom wall 30.

Figure 2:
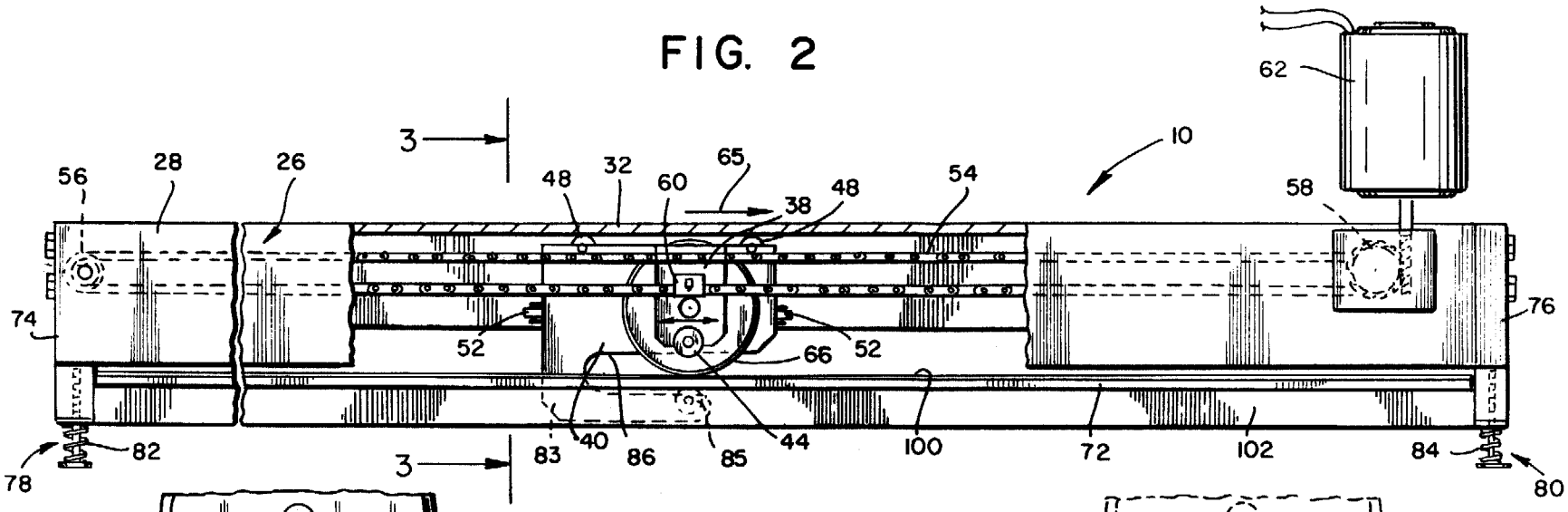
FIG. 2 is a top view of the cutter box assembly of FIG. 1 with portions of the cover shown broken away to reveal details of internal construction.

Also located within the cutter box housing 26 is an endless drive chain 54 which is trained about a pair of sprockets 56 and 58, located on opposite sides of the housing 26 adjacent the top wall 28 thereof. A bracket 60 is mounted in upstanding position on the upper plate 38 of the cutter frame 36, and is secured to an intermediate portion of the drive chain 54, as shown in FIGS. 2 and 3. A reversible electric motor 62 is mounted on the machine carriage 20 and rotates the sprocket 58 through a drive gear 64. The motor 62 thus operates to drive the cutter frame 36 transversely back and forth across the width of the machine carriage 20, in the direction shown by the arrow 65 in FIG. 2.

The cutter box assembly 10 also includes a circular cutter disk 66 which is journalled by means of a sleeve 68 upon a cylindrical post 70 extending between the upper and lower plates 38 and 40 of cutter frame 36. The disk 66 is thus mounted for free rotation within the cutter frame 36, and is so positioned that its peripheral cutting edge bears against a pressure bar 72, as shown in FIGS. 3 and 5. When the cutter frame 36 is driven transversely across the width of the machine carriage 20, the disk 66 rolls along the surface of the pressure bar 72 and is rotated thereby. The disk 66 has no separate power drive for rotating it, as is conventional with the usual cutting disks of the slitting type.

The cutter box housing 26 has end plates 74 and 76, each of which includes a support assembly 78, 80 which mounts a respective end of the pressure bar 72. The support assemblies 78, 80 include helical compression springs 82 and 84 which urge the pressure bar 72 against the cutter disk 66. In use of the spreading machine 12, the sheet material 14 to be spread on the table 16 is fed through the cutter box assembly 10, between the open front face of the cutter box housing 26 and the pressure bar 72 as shown in FIGS. 1 and 3. When the cutter frame 36 is driven in a cutting stroke, from left to right through the housing 26 as viewed in FIG. 2, the circumferential edge of the cutter disk 66 bears against the pressure bar 72 under tension of the compression springs 82 and 84, and rotates as it is moved transversely with said cutter frame 36. When the cutter disk 66 reaches the sheet material 14, it presses said material firmly against the pressure bar 72, and in its rotary movement performs a scoring cut across the width of the material to sever the same, in a manner to be presently described.

As indicated above, the helical compression springs 82 and 84 of the support assemblies 78 and 80 urge the pressure bar 72 firmly against the edge of the cutter disk 66. To insure such engagement, the bottom plate 40 of cutter frame 36 includes an integral arm portion 83 which projects below the pressure bar 72, as is best shown in FIGS. 2 and 3, and a cam follower roller 85 which is mounted on the end of arm portion 83. As shown in FIG. 5, the arm portion 83 is parallel to the axis of the bottom plate 40 and is spaced therefrom to provide a slot 86 therebetween, which slot is open at its right-hand end as viewed in FIG. 5.

The cam follower roller 85 is journalled on an axle 87 which upstands from a circular cam shaft 88 and is offset from the center of the latter. The cam shaft 88 fits rotatably within a circular aperture at the end of the arm portion 83 and may be manually turned in said aperture by means of a hexagonal collar 90. to a selected operative position. The cam shaft 88 may be locked in this selected position on the arm 83 by means of a set screw 92 (FIG. 7).

The cam follower roller 85 bears against the forward surface 94 of the pressure bar 72 and acts as a stop to prevent movement of the pressure bar in a forward direction, away from the cutter disk 66. The cam shaft 88 permits cam-like adjustment of the cam follower roller 85 for materials of different thicknesses. Once adjusted for a given material thickness, the cam follower roller 85 prevents the pressure bar 72 from flexing outwardly away from the cutter disk 66, under tension of springs 82, 84. Such outward flexing is undesirable, since it could cause an interruption in the cut. The roller 85 prevents the flexing and springing of the pressure bar 72 even in the event that the sheet material 14 being cut folds over itself or bunches up while being cut.

In contrast to conventional cutter blades or disks which rely on a highly sharpened cutting edge for the cutting operation, the cutter disk 66 of the present invention has a rounded edge 96, as shown in FIG. 8. This rounded edge 96 cooperates with the pressure bar 72 to create a scoring action which causes the sheet material 14 to part cleanly. Because the cutter disk does not require the usual sharp knife edge, there is no necessity for halting operation of the machine at frequent intervals for purposes of sharpening the cutter disk.

At the start of operation of the cutter box assembly 10, the cutter frame 36 is disposed at the extreme left-hand side of the machine carriage 20, as viewed in FIGS. 1 and 2. The sheet material 14 is fed from the supply roll 18 into engagement with the positive feed roller 24, and thence downwardly through the cutter box assembly 10. Beneath the cutter box assembly, the material feeds between a pair of rollers 97 and 99, in the manner shown in FIG. 3, which rollers maintain the sheet material flush against the surface 100 of the pressure bar 72.

Electrical limit switches, which are conventional in nature, cause the electric motor 62 to drive the endless chain 54 in such a manner as to drive the cutter frame 36 in the direction shown by the arrow 65 in FIG. 2. As the cutter frame 36 moves in this direction, the cutter disk 66, which is rotatably mounted in the cutter frame 36, rolls along the pressure bar 72 and rotates in the direction shown by the arrow 98 in FIG. 5. When the cutter frame 36 reaches the sheet material 14, the material enters the open end of the slot 86 and is engaged by the rotating cutter disk 66 which scores the material 14 causing it to part. The arm 83 on which the cam follower roller 85 is mounted, passes through the already cut portion of the sheet material. When the cutter frame 36 reaches the extreme right-hand portion of the machine carriage 20, as viewed in FIG. 2, electrical limit switches and timing switches stop the rotation of motor 62, and after a short interval of time has elapsed, reverse the direction of rotation of said motor 62, thereby reversing the direction of movement of the drive chain 54. The cutter frame 36 is thus returned to its original extreme left-hand position, in preparation for the next cut.

Figure 4:
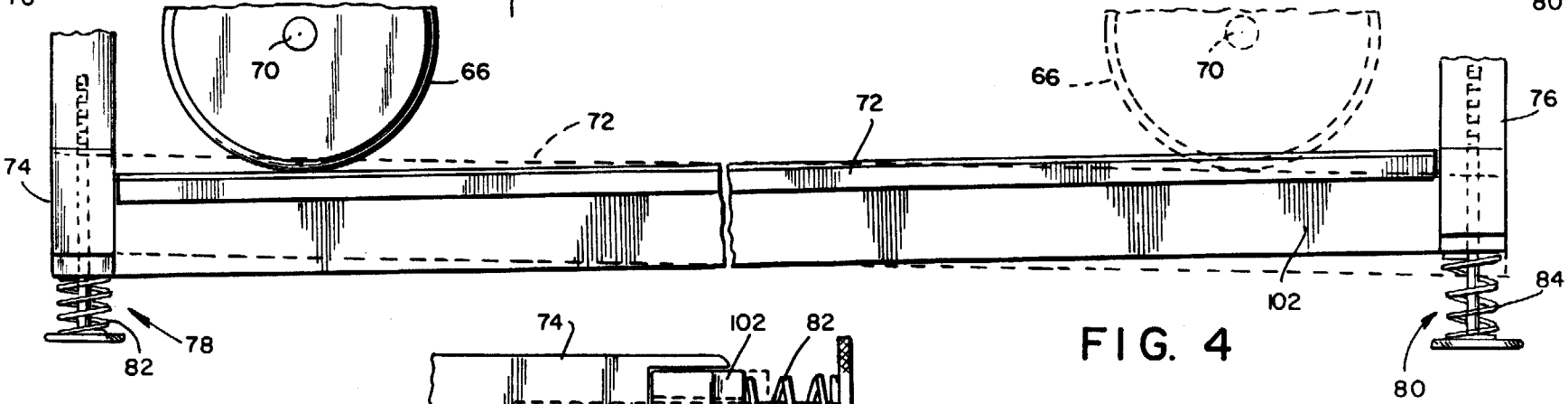
FIG. 4 is a fragmentary top view similar to FIG. 2, drawn to an enlarged scale, showing in solid line the position of the component parts when the cutter disk is in a first position, and showing in broken line the position of the component parts when the cutter disk is in a second position.
Figure 6:
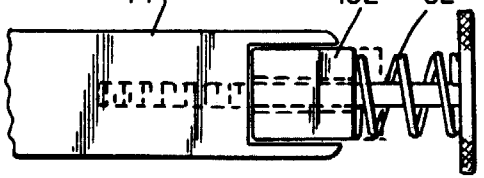
FIG. 6 is a fragmentary top view of the pressure bar support assembly drawn to an enlarged scale.

As shown in FIG. 4, the compression springs 82, 84 provide a self-leveling feature so that when the cutter disk 66 is in the left-hand position, there is greater force on the compression spring 82 than on the spring 84, and the pressure bar 72 tilts in the direction shown by the solid lines in FIG. 4. When the cutter disk 66 moves to the right-hand position, the pressure bar 72 tilts in the opposite direction, as shown by the broken lines in FIG. 4. This self-leveling feature prevents the cutter disk from exerting undue pressure against the pressure bar 72, which would result in excessive wear of the surfaces of the cutter disk and pressure bar.

The pressure bar 72 is manufactured of hardened steel and consequently the surface 100 which bears against the cutter disk 66 is extremely hard and resistant to deformation. However, after an extended period of use, the portion of the surface 100 which bears against the cutter disk 66 can become scored. The pressure bar 72 is mounted on a back-up bar 102 by a plurality of screws which are disposed so that the distance between the upper screws, indicated in FIG. 3 by the center line 104, and the center of the cutter disk 66 is greater than the corresponding distance between the center of the cutter disk 26 and the lower screws which are indicated in FIG. 3 by the center line 106. This non-symmetrical configuration of the mounting screws enables the pressure bar 76 to be removed and replaced after being inverted so that the upper surface 108 is now on the bottom. This action brings a fresh portion of the surface 100 to bear against the cutter disk 66. The pressure bar 72 may also be turned so that the opposite surface 110 bears against the cutter disk 66. In this manner a total of four different surface portions can be brought to bear against the cutter disk 66.

In alternative embodiments of the invention, which are not shown, the helical compression springs 82, 84 may be replaced by pneumatic or hydraulic actuators which urge the pressure bar to bear against the circular cutter disk 66.

While preferred embodiments of the invention have been shown and described herein, it is obvious that numerous additions, changes and omissions may be made in such embodiments without departing from the spirit and scope of the invention.

What is claimed is:

1. A sheet material spreading machine comprising a carriage mounted for movement along a table surface and carrying a supply of continuous sheet material to be deposited in superimposed layers on said table surface, with a layer deposited in each operative run of said carriage along said table surface, a cutter box assembly mounted on said carriage and adapted to cut off the layer of sheet material deposited on the table surface at the end of each operative run of said carriage, and means for guiding and feeding said sheet material from said supply, through said cutter box assembly to the table surface, said cutter box assembly comprising an elongated support member mounted on said spreading machine carriage and extending transversely thereof, a cutter frame movably mounted on said support member, guide means on said support member for guiding movement of said cutter frame in opposite directions along said support member, a circular cutter member rotatably mounted on said cutter frame in a horizontal position and having a peripheral cutting edge portion, a pressure bar movably mounted on said cutter box housing and having a planar inner surface in engagement with the cutting edge portion of said cutter member, and a planar outer surface, said sheet material being fed between said cutter member and the planar inner surface of said pressure bar, a retaining member mounted on said cutter frame and engaging the planar outer surface of said pressure bar for retaining said pressure bar against movement away from said cutter member, and biasing means mounted on said cutter box support member and adapted to urge said pressure bar into firm engagement with said cutter member, thereby causing said cutter member to score sheet materials fed between said cutter member and said pressure bar under rolling action of said cutter member against said pressure bar as said cutter member is carried by said cutter frame and rolls along said support member.

2. A sheet material spreading machine according to claim 1 in which said circular cutter member comprises a disk having a convexly rounded peripheral edge surface.

3. A sheet material spreading machine according to claim 1 in which said circular cutter member includes a relatively thick central portion, a tapered intermediate portion and a relatively thin convexly rounded cutting edge portion with said tapered portion forming a transition between said relatively thick central portion and said relatively thin cutting edge portion.

4. A sheet material spreading machine according to claim 1 in which said circular cutter member comprises a disk having a blunt outer edge.

5. A sheet material spreading machine according to claim 1 in which said biasing means comprises a pair of helical compression springs mounted one each at opposite end portions of said pressure bar and disposed to urge said pressure bar to bear against said circular cutter member.

6. A sheet material spreading machine according to claim 1 in which said drive means comprises a drive chain movably mounted on said elongated support member, a reversible electric motor for driving said drive chain alternately in opposite directions, and coupling means connecting said drive chain to said cutter frame.

7. A sheet material spreading machine according to claim 1 in which said cutter frame includes an extension arm portion spaced from said cutter frame and extending parallel thereto, said extension arm portion projecting from said cutter frame to a location behind said pressure bar, and in which said retaining member comprises a roller mounted on said extension arm portion and disposed to engage and roll along the outer planar surface of the pressure bar.

8. A sheet material spreading machine according to claim 7 which also includes adjusting means for varying the bearing force of said roller against said pressure bar.

9. A sheet material spreading machine according to claim 8 in which said adjusting means comprises cam means mounting said roller on said extension arm portion, said cam means being selectively adjustable for varying the bearing force between said pressure bar and said roller, thereby facilitating operation of the cutter box assembly to cut materials to different thicknesses.

10. A sheet material spreading machine according to claim 6 further comprising timing means disposed to create a time delay between motion of said chain in a first direction and motion of said chain in the opposite direction.

11. A sheet material spreading machine according to claim 1 in which said pressure bar is made of hardened steel.

12. A sheet material spreading machine according to claim 1 in which said pressure bar is removably mounted on said support member asymmetrically with respect to the elevation of said circular cutter member, whereby said pressure bar may be removed from said support member, inverted, and remounted on said support member, thereby causing a new surface area of said pressure bar to bear against said circular cutter member.

13. A sheet material spreading machine according to claim 11 in which said pressure bar has a first surface bearing against said circular cutter member, and a second surface opposite said first surface, and in which said pressure bar is adapted to be removed from said cutter box housing and repositioned with said second surface bearing against said circular cutter member.

* * * * *